United States Patent [19]

Saunders et al.

[11] 3,984,202

[45] Oct. 5, 1976

[54] ALKANOLAMINES TO REDUCE OZONE ATTACK ON DYES IN POLYAMIDE FIBERS

[75] Inventors: Peter Reginald Saunders; Robert Alden Lofquist, both of Richmond, Va.

[73] Assignee: Allied Chemical Corporation, Petersburg, Va.

[22] Filed: Oct. 5, 1973

[21] Appl. No.: 404,064

Related U.S. Application Data

[63] Continuation-in-part of Ser. No. 226,244, Feb. 14, 1972, abandoned.

[52] U.S. Cl. ..... 8/165; 8/173; 8/168 B

[51] Int. Cl.[2] ..... D06P 5/02

[58] Field of Search ..... 8/165, 74

[56] References Cited

UNITED STATES PATENTS

| | | | |
|---|---|---|---|
| 2,409,325 | 10/1946 | Ward et al. | 8/165 |
| 3,071,427 | 1/1963 | Buehler | 8/22 |
| 3,096,139 | 7/1963 | Hindle | 8/21 A |

OTHER PUBLICATIONS

Salvin, Amer. Dyestuff Reporter, Jan. 6, 1964, pp. 12–19.

*Primary Examiner*—Donald Levy
*Attorney, Agent, or Firm*—Richard A. Andersen

[57] ABSTRACT

When from about 0.4 percent to about 3 percent of an alkanolamine such as:

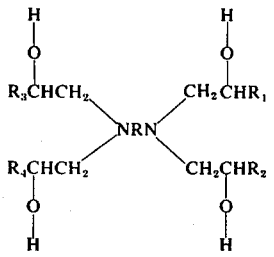

where R is an alkylene of 1 to 13 carbon atoms, an aralkyl such as xylylene, or cycloalkyl, $R_1$, $R_2$, $R_3$, and $R_4$ are H, alkyl of 1-2 carbon atoms or phenyl wherein $R_1$, $R_2$, $R_3$, and $R_4$ can be the same or different, is coated on nylon fiber, improved dyefastness is achieved when the fiber is exposed to ozone.

8 Claims, No Drawings

ALKANOLAMINES TO REDUCE OZONE ATTACK ON DYES IN POLYAMIDE FIBERS

This is a continuation-in-part application of U.S. application Ser. No. 226,244, filed Feb. 14, 1972, now abandoned.

BACKGROUND OF THE INVENTION

The object of this invention is to reduce or prevent the fading of dyed nylon fabrics caused by ozone. By fading is meant loss of fastness of the dye, i.e., the dye becomes less bright or changes color, for example, dark blue to light blue.

Ozone is present in air at sea level at a concentration of only 1 to 5 parts per hundred million. Only under conditions of heavy smog does it rise as high as 60 parts per hundred million. Despite this extremely low concentration of ozone, severe fading is observed.

Ozone is an allotropic form of oxygen. The molecule of ozone consists of three atoms of oxygen whereas a molecular of oxygen contains two atoms of oxygen. Ozone is formed in the upper atmosphere by the action of high energy radiation from the sun splitting oxygen molecules into two oxygen atoms. These atoms then combine with oxygen ($O_2$) molecules to form ozone ($O_3$). This ozone then diffuses down through the atmosphere.

Ozone is an electrophilic reagent, that is, it searches out and attacks electron pairs such as those existing with carbon-carbon double bonds.

The dyes which are attacked are usually anthraquinone type disperse dyes, although it is believed that under severe conditions almost all dyes might be affected by ozone. Cationic dyes are also susceptible.

One of the most sensitive dyes to ozone fading is Disperse Blue 3. The major constituent of Disperse Blue 3 has the structure:

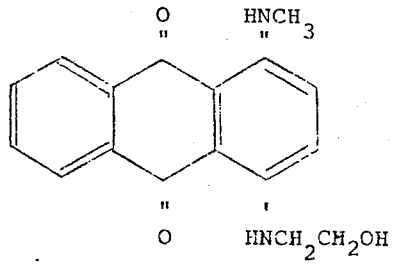

Basic anthraquinone dyes, such as C. I. Basic Blue 47, are also subject to ozone fading as shown in Examples II to IV. Typical anthraquinone dyes are shown by U.S. Pat. No. 2,900,216. Analysis of C. I. Basic Blue 47 or Astrazon Blue 3RL has shown it is quaternized from the compound labeled 2 in the list of compounds on page 1 of U.S. Pat. No. 2,900,216. Thus, the structure would be:

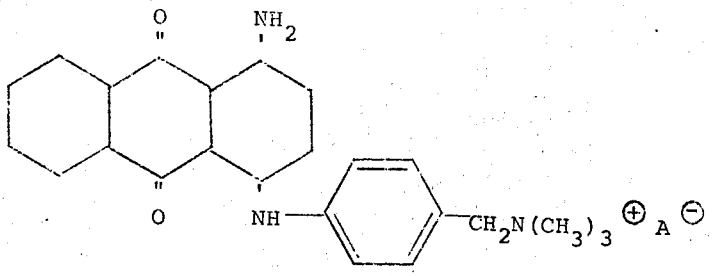

where A is an anion, such as $Cl^-$. The 1963 Supplement of the Colour Index also indicates Astrazon Blue 3RL is an anthraquinone.

The dye diffuses through the fiber to contact the ozone at the surface of the fiber. Part of the evidence for this is that any treatment or additive that increases the mobility of the dye, increases its ozone fading.

There is some evidence that water is necessary to give ozone fading, but whether its action is that it swells the nylon or is involved in a primary or secondary oxidation step is unclear.

Ozone fading can be decreased by reduction of the specific surface area of the yarn. This is undesirable when a bulky yarn is required. Ozone fading can also be decreased by changes in polymer morphology and orientation but these techniques are inherently expensive.

SUMMARY OF THE INVENTION

A method and composition have been found for improving fastness of dyes when exposed to ozone in polycarbonamide fibers. The method is exposing the fibers to ozone in the presence of an alkanolamine such as:

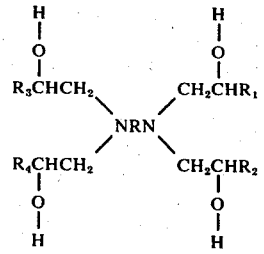

where R is an alkylene of 1 to 13 carbon atoms, an aralkyl such as xylylene, or cycloalkyl, $R_1$, $R_2$, $R_3$, and $R_4$ are H, alkyl of 1–2 carbon atoms or phenyl wherein $R_1$, $R_2$, $R_3$, and $R_4$ can be the same or different. These compounds can be prepared by the process described in U.S. Pat. No. 2,697,118 to Lunsted et al.

One of these compounds or mixtures of them can be coated on nylon fiber in the form of yarn in amounts of from about 0.4 to about 6 percent, preferably from 1 to about 3 percent on weight of the fiber. The coating may be applied by contacting a composition of the above compounds with yarn in a dyebath or by spraying onto the finished textile or carpet. When R is 6 to 13 carbon atoms and $R_1$, $R_2$, $R_3$ and $R_4$ are phenyl, the coating can be applied as a yarn finish such as a spin finish prior to dyeing. The rate of fading of the dye in nylon fibers, particularly disperse or cationic dyes, is substantially reduced by the incorporation or coating of these compounds. This ozone fading reduction is particularly beneficial in fabrics such as carpets.

DESCRIPTION OF THE PREFERRED EMBODIMENTS

Some of the preferred embodiments of this invention are set forth in the following examples. The method of testing for ozone fading was similar to the AATCC 129-1968 set forth on page 334/15 of the *Journal of American Association of Textile Chemists and Colorists*, July 30, 1969, Volume 1, No. 16, in an article entitled, "A New Test Method For Ozone Fading at High Humidity", by Victor S. Salvin.

Δ E is a measure of the change of color, a smaller Δ E being less fading.

Color Difference (Δ E)

$$\Delta E = \sqrt{(\Delta L)^2 + (\Delta a)^2 = (\Delta b)^2}$$

where $\Delta L = L_1 - L_2$ $\Delta a = a_1 - a_2$ $\Delta b = b_1 - b_2$

L, *a* and *b* are readings on the Hunterlab Color Difference Metter. L is a 100-0 reading of white to black measurement. *a* measures redness when + and gray when zero, and green when minus. *b* measures yellow when +, gray when zero and blue when minus.

The Hunterlab Color Difference Meter measures color as seen in average daylight, in a manner similar to the way in which the human dye responds to the stimulus of color. Experimentation has shown that the eye can match any color when a combination of three "primary" colored lights, and therefore, that any color can be specified by a three dimensional identification. The Color Difference Meter measures the light reflected by a specimen through filters that correspond to the three "primary" lights. The measurements made, therefore, correspond to the way the average human eye responds to light, as these responses are set forth in the CIE "Standard Observer". The "Standard Observer" is a table of values derived from experiments with human observers, and recommended for use in 1931 by the International Commission on Illumination (ICI).

EXAMPLE I

Polycaprolactam was made by heating a mixture of 1520 grams caprolactam, 80 grams aminocaproic acid, 0.16 gram of a 50% solution of hypophosphorous acid, 0.06 gram of $MnCl_2 \cdot 4H_2O$, and 5.2 grams of a 50% dispersion of $TiO_2$ in water and caprolactam, to 255° and held at 255°C. for 3½ hours, with agitation under nitrogen.

After leaching out the unreacted monomer, the polymer had a 53 formic acid relative viscosity with 56 amine ends and 52 carboxyl ends. The polymer was spun into 16 round cross-section filaments having a total denier of about 230, at a spinning temperature of 265°, and then drawn at a ratio of 3.2 to give a drawn denier of 70.

The yarn was knitted into sleeves, and scoured with a solution of 0.5% on weight of fabric (O.W.F.) Triton X-100 a nonionic alkaryl polyether alcohol by Rohm & Haas, and 2.0% (O.W.F.) trisodium phosphate at 160°F. for 30 minutes. The sleeves were dyed with Olive I dye, a tertiary shade which consists of 0.69% (O.W.F.) C.I. Disperse Blue 3, such as Celliton Blue FFRN (C.I. No. 61505), 0.0807% (O.W.F.) Celliton Pink RF (C.I. No. 60755), and 0.465% (O.W.F.) Celliton Yellow GA (C.I. No. 11855). Disperse Blue 3 dye is especially sensitive to ozone.

The dyed sleeve was then exposed to an atmosphere containing about 80 pphm of ozone, at a temperature of 104°F. at about 95% relative humidity for three fading cycles.

A cycle of ozone is that exposure which causes a nylon control fabric that has been dyed Olive I, to fade a specified amount. A higher Δ E under these conditions means more fading of the Disperse Blue 3 dye.

After three cycles the dyed sleeve of this example had a Δ E of 9.

EXAMPLE II

Cationic dyeable polycaprolactam having a formic acid relative viscosity (FAV) of 60, and containing about 90 equivalents of sulfonate as sodium sulfoisophthalic acid, about 80 carboxyls and about 20 amines per $10^6$ grams polymer was spun at 280°C., plied and drawn at a ratio of 3.2 into a 140-filament, 2100 denier yarn. Each filament had a Y-cross-section with a 3.2 modification ratio. The yarns were knitted into sleeves, heat set by steaming in an autoclave at 230°F. for 5 minutes, followed by 3 10-minute cycles of steam treatment at 260°F.

The sleeves were dyed individually to a moss green in a dyebath containing 0.3% Sevron Yellow 8GMF (DuPont) (C.I. Basic Yellow 53)

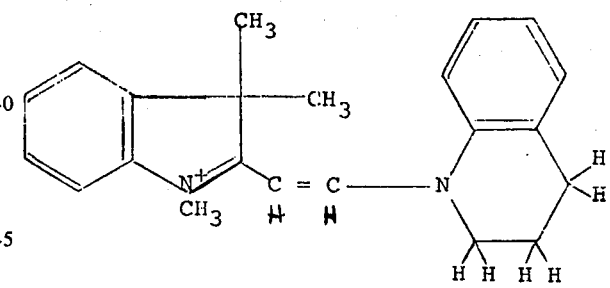

0.25% Astrazon Blue 3 RL (C.I. Basic Blue 47), 2% Hypochem PND-11 amine salt of alcohol ester by Highpoint Chemical Co., 1% Hypochem CDL-60 nonionic surfactant by Highpoint Chemical Co. (chemical structure not available) and enough mono- and/or disodium phosphate to adjust the pH to neutral. One 8-inch sleeve was submerged in a solution of 5 cc of N,N,N',-N'-tetrakis(2-hydroxyethyl)-1,6-diaminohexane in 400 cc. of acetone. The pickup of triethanol amine was 0.8% based on increase in weight. A 8-inch control sleeve was submerged in 400 cc. of acetone for the same length of time. The weight of the sleeve after acetone treatment was unchanged.

The sleeves were then subjected to an ozone atmosphere of about 80 pphm ozone at a temperature of 104°F., at a relative humidity of at least 95%, for three cycles. A cycle is that amount of exposure which occurs when a nylon control fabric dyes Olive 1 shows a specified color change as measured by a colorimeter.

This method is similar to, but not identical with, proposed AATCC Test Method 129-1968.

The results of the sleeves being exposed to 3 cycles of ozone are as follows:

| | ΔE | ΔL |
|---|---|---|
| sleeve with 0.8 N,N,N',N'-tetrakis (2-hydroxyethyl)-1,6-diaminohexane | 2.8 | 1.5 |
| Control | 7.3 | 4.5 |

EXAMPLE III

Cationic dyeable polycaprolactam having a formic acid relative viscosity (FAV) of 60, and containing about 90 equivalents of sulfonate as sodium sulfoisophthalic acid, about 80 carboxyls and about 20 amines per $10^6$ grams polymer was spun at 280°C., plied and drawn at a ratio of 3.0, then chopped to 7-inch lengths, carded and spun into staple with a cotton count of 2. Each filament had a Y-cross-section with a 3.2 modification ratio. The yarns were knitted into sleeves, heat set by steaming in an autoclave at 230°F. for 5 minutes, followed by 3 10-minute cycles of steam treatment at 260°F.

The sleeves were dyed individually to a moss green in a dyebath, containing 0.3 percent (O.W.F.) Sevron Yellow 8 GMF, 0.25% Astrazon Blue 3 RL, 2% Hypochem PND-11, 1% Hypochem CDL-60 and enough mono- and/or disodium phosphate to adjust the pH to neutral.

The sleeves were cut into 5 inch long segments, weighed and then soaked in the following solutions of diamines for 20 minutes. The sections of sleeve were dried in air for 2 hours, weighed to determine the pickup of diamine and then exposed to 3 cycles of ozone as described in Example II.

| Solution | % Pickup | 3 Cycles Δ E |
|---|---|---|
| 0.5 gram N,N,N',N'-tetrakis(2-hydroxyethyl)-1,2,-diaminoethane in 400 cc ethanol | 0.17 | 2.4 |
| 1.0 gram N,N,N',N'-tetrakis(2-hydroxyethyl)-1,2-diaminoethane in 400 cc ethanol | 0.44 | 1.3 |
| 0.5 gram N,N,N',N'-tetrakis(2-hydroxypropyl)-1,2-diaminoethane in 400 cc methanol | 0.32 | 3.8 |
| 1.0 gram N,N,N',N'-tetrakis(2-hydroxy) propyl)-1,2-diaminoethane in 400 cc methanol | 1.14 | 2.7 |
| 3.0 grams N,N,N',N'-tetrakis(2-hydroxypropyl)-1,2-diaminoethane in 400 cc methanol | 1.84 | 1.7 |
| Control | 0 | 6.0 |

Thus, alkanolamines greatly diminish the ozone fading.

EXAMPLE IV

The sleeves of the same yarn as described in Example III were cut into sections, soaked in the following solutions and then exposed to 3 cycles of ozone using the methods of Example III.

| Solution | % Add On | 3 Cycles Δ E |
|---|---|---|
| 5 grams N,N,N',N'-tetrakis(2-hydroxyethyl)-m-xylylenediamine in 200 cc. methanol | 5.2 | 1.2 |
| 5 grams N,N,N',N'-tetrakis(2-hydroxypropyl)-1,4-bis(aminomethyl)-cyclohexane in 200 cc methanol | 5.3 | 1.9 |
| 1 gram N,N,N',N'-tetrakis(2-hydroxyethyl)-1,12-diaminododecane in 200 cc methanol | 0.86 | 3.2 |
| 5 grams N,N,N',N'-tetrakis(2-hydroxybutyl)-1,4-diaminobutane in 200 cc methanol | 5.0 | 1.7 |
| 5 grams N,N,N',N'-tetrakis(2-hydroxyethyl)-m-phenylenediamine in 200 cc methanol | 5.2 | 8.3 |
| 0 Control in 200 cc methanol | — | 10.9 |

From known experience with other compound known as antiozonants for dye in polycarbonamide, these successful compounds will also be useful on all polycarbonamides.

EXAMPLE V

The polymer of Example I was spun into 16 round cross-section filaments having a total denier of about 230, at a spinning temperature of 270, using a spin finish. The spin finish was an emulsion of 10% by weight of the product of reaction between one mole of hexamethylenediamine and four moles of styrene oxide in a commercial aqueous spin finish. The pick-up of the additive on the yarn was about 1%, based on a finish pick-up of about 10%.

The yarn was drawn at a ratio of 3.2 to give a drawn denier of 70. The yarn was knitted into sleeves and dyed as in Example I. The dyed sleeves were then exposed to an ozone atmosphere similar to that of Example I. After three cycles of exposure the dyed sleeves had a Δ E of 2.3.

A second yarn was spun using a spin finish containing 10% of the product of reaction of one mole of 1,12-diaminododecane and four moles of styrene oxide. The pick-up of the additive was about 0.9% based on a finish pick-up of about 9%. The yarn was drawn, knitted, dyed and exposed to ozone as was the yarn above. The Δ E after ozone exposure was 3.1.

Cationic dyeable polymer similar to that of Example II was spun using the spin finish described above which contained 10% of the product of reaction between one mole hexamethylene diamine and four moles of styrene oxide. The main product of this reaction is:

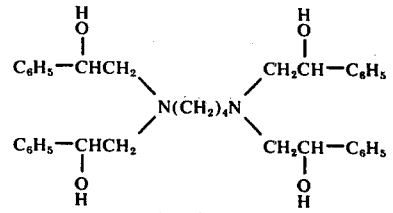

The yarn was drawn, knitted, heat set, dyed and exposed to ozone as in Example II. The Δ E after exposure was 2.2.

Thus, it is clear that the compounds of this invention remain on fibers in the fabric to substantially reduce fading of anthraquinone based dyes due to ozone, after all the fabric processing is completed as in the Examples.

We claim:

1. In a method for dyeing nylon fibers with anthraquinone dyes, the improvement comprising coating said fiber with a substance consisting essentially of a compound selected from the group consisting of an alkanolamine having the structure

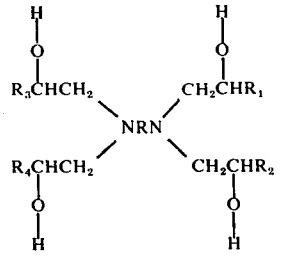

where R is an alkylene of 1 to 13 carbon atoms, an aralkyl, or cycloalkyl, $R_1$, $R_2$, $R_3$, and $R_4$ are H, alkyl of 1–2 carbon atoms or phenyl wherein $R_1$, $R_2$, $R_3$, and $R_4$ can be independently selected;

so that from about 0.4 to about 6 percent on weight of fiber of said compound remains on said fibers to reduce the fading of dyed polycarbonamide fabrics caused by ozone.

2. The method of claim 1 wherein said coating is applied concurrently to dyeing said fiber by adding said compound to a dyebath.

3. The method of claim 1 wherein said fiber coating is applied subsequently to dyeing said fiber.

4. The method of claim 1 wherein said anthraquinone dyes are disperse dyes.

5. The method of claim 1 wherein said anthraquinone dyes are basic dyes.

6. A method for improving dyefastness of anthraquinone dyes when exposed to ozone on nylon yarns consisting of coating said yarns with a substance consisting essentially of a compound selected from the group consisting of:

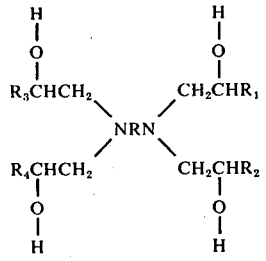

where R is an alkylene of 1 to 13 carbon atoms, an aralkyl, or cycloalkyl, $R_1$, $R_2$, $R_3$, and $R_4$ are H, alkyl of 1–2 carbon atoms or phenyl wherein $R_1$, $R_2$, $R_3$, and $R_4$ can be independently selected, in an amount from about 0.4 to about 6 percent on weight of fiber, remaining on said yarn to substantially reduce the rate of fading due to exposure of fabric of said dyed yarn to ozone.

7. The method of claim 6 wherein said compound is present in an amount between about 1 and about 3 percent on weight of fiber.

8. The method of claim 7 wherein R has 6 to 13 carbon atoms, $R_1$, $R_2$, $R_3$ and $R_4$ are phenyl and said coating is applied as a yarn finish.

* * * * *